US010071471B2

(12) United States Patent
Lawless

(10) Patent No.: US 10,071,471 B2
(45) Date of Patent: Sep. 11, 2018

(54) PRY BAR HANDLE

(71) Applicant: Mayhew Steel Products, Inc., Turner Falls, MA (US)

(72) Inventor: John C. Lawless, Conway, MA (US)

(73) Assignee: MAYHEW STEEL PRODUCTS, INC., Turner Falls, MA (US)

( * ) Notice: Subject to any disclaimer, the term of this patent is extended or adjusted under 35 U.S.C. 154(b) by 0 days.

(21) Appl. No.: 14/827,729

(22) Filed: Aug. 17, 2015

(65) Prior Publication Data

US 2017/0050306 A1 Feb. 23, 2017

(51) Int. Cl.

| | |
|---|---|
| ***B25G 1/00*** | (2006.01) |
| ***B25G 1/01*** | (2006.01) |
| ***B25G 1/10*** | (2006.01) |
| ***E04G 23/08*** | (2006.01) |
| ***B25F 1/00*** | (2006.01) |

(52) U.S. Cl.

CPC ..... *B25G 1/102* (2013.01); *B25G 1/00* (2013.01); *B25G 1/01* (2013.01); *B25G 1/10* (2013.01); *E04G 23/08* (2013.01); *B25F 1/00* (2013.01); *E04G 2023/085* (2013.01)

(58) Field of Classification Search

CPC .. B25G 1/01; B25G 1/105; B25G 1/10; B25B 15/004; B25B 15/005; B66F 15/00; B25F 1/00; B25D 1/02

See application file for complete search history.

(56) References Cited

U.S. PATENT DOCUMENTS

| | | | | | |
|---|---|---|---|---|---|
| 2,123,393 | A * | 7/1938 | Windsor | B25G 1/00 | 279/95 |
| 4,622,707 | A * | 11/1986 | Finn | B25F 1/00 | 294/2 |
| 4,712,304 | A | 12/1987 | Sanelli | | |
| 4,951,533 | A * | 8/1990 | Hillinger | B25B 15/02 | 16/DIG. 12 |
| D310,472 | S * | 9/1990 | Mader | D8/107 | |
| 4,969,231 | A * | 11/1990 | Mader | B25G 1/00 | 16/421 |
| D329,367 | S * | 9/1992 | Landy | D8/83 | |
| 5,211,085 | A * | 5/1993 | Liou | B25G 3/36 | 81/20 |
| 5,390,572 | A | 2/1995 | Gakhar | | |
| D414,096 | S * | 9/1999 | Chapin | D8/107 | |
| 5,956,799 | A | 9/1999 | Panaccione | | |
| 5,964,009 | A * | 10/1999 | Hoepfl | B25G 1/105 | 16/430 |
| 6,058,809 | A | 5/2000 | Flanz | | |
| 6,196,088 | B1 * | 3/2001 | Youngren | B25D 1/00 | 7/143 |
| 6,471,186 | B1 * | 10/2002 | Lawless | B25C 11/00 | 254/25 |
| 6,772,994 | B1 | 8/2004 | Lawless | | |

(Continued)

*Primary Examiner* — Christopher M Koehler
*Assistant Examiner* — Seahee Yoon
(74) *Attorney, Agent, or Firm* — Lackenbach Siegel, LLP

(57) ABSTRACT

A pry bar has a transversely disposed generally triangular cross-section handle grip portion having surfaces formed of a soft elastomeric over-molded material. The handle is formed with an inner hard thermoplastic core and molded over outer elastomeric cover. A metal tether receiving element and impact cap are fixedly secured at the handle proximate end.

12 Claims, 10 Drawing Sheets

(56) References Cited

U.S. PATENT DOCUMENTS

| | | | | |
|---|---|---|---|---|
| 6,889,405 | B2 * | 5/2005 | Ritrovato | B25G 1/10 15/143.1 |
| 7,152,511 | B2 * | 12/2006 | Fen | B25G 1/00 16/111.1 |
| 7,269,867 | B2 * | 9/2007 | Karlstedt | B25D 3/00 7/105 |
| 7,467,572 | B2 * | 12/2008 | Fisher | B25D 1/045 81/20 |
| 7,523,525 | B2 * | 4/2009 | Lawless | B25B 33/00 16/430 |
| 8,032,991 | B2 | 10/2011 | Lawless | |
| 8,047,099 | B2 * | 11/2011 | St. John | B25D 1/04 81/20 |
| 2002/0134971 | A1 | 9/2002 | Christensen | |
| 2006/0026800 | A1 * | 2/2006 | Lawless | B25G 1/105 16/430 |
| 2008/0276770 | A1 * | 11/2008 | Blum | B25B 15/02 81/489 |
| 2012/0255180 | A1 * | 10/2012 | Powers | B25D 3/00 30/167.1 |
| 2014/0103089 | A1 * | 4/2014 | Hale | B25C 3/004 227/147 |

* cited by examiner

PRY BAR HANDLE

BACKGROUND OF THE INVENTION

Field of the Invention

This invention relates to hand tools and hand tool handles. This invention specifically relates to pry bars and pry bar handles. This invention more specifically relates to an ergonomic handle for a series of pry bars.

Background and Discussion of the Prior Art

In general, pry bars are of all metal construction and are cumbersome to grip and use. Often the user has to grip a polygonal cross-sectional metal bar portion of the pry bar. One such prior art construction is disclosed in U.S. Pat. No. 6,058,809 to Flanz. A wrecking tool is disclosed in U.S. Patent application Publication No. 2002/0134971 to Christensen. The Christensen tool has an elongate octagonal cross-sectional metal handle or bar stock portion. A round bar stock is transversely attached to the octagonal metal pry bar to serve as a handgrip.

It is generally known to provide a soft elastomeric molded over cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

Improvements in pry bar handles are disclosed in U.S. Pat. No. 6,471,186, granted Oct. 2, 2002 to Lawless, U.S. Pat. No. 6,772,994, granted Aug. 10, 2004 to Lawless, U.S. Pat. No. 7,293,331, granted Nov. 13, 2007 to Lawless and U.S. Pat. No. 8,032,991, granted Oct. 11, 2011 to Lawless (hereinafter the "Lawless patents"). The Lawless patents generally disclose symmetrically circumferentially disposed hard thermoplastic grip elements and in combination with soft elastomeric grip elements. The Lawless patents' handles did not provide the desired ergonomic grip, particularly for the large or commercial use elongate pry bars and more particularly for differently elongated pry bars.

It is still a further object of the present invention to provide an ergonomic pry bar handle that is of practical design and safe and practical in commercial scale and use.

SUMMARY OF THE INVENTION

The pry bar, in one aspect, has a handle with a transversely disposed generally triangular cross-section with a plurality of grip surfaces. The outwardly disposed side grip surfaces have rounded soft thermoplastic material surfaces. The surface has a plurality of spaced oval thermoplastic grip elements, the number of wall grip elements being commensurately proportioned to the length of the handle. The user grips the differently disposed and configured elastomeric surfaces of the oval shaped elements for a secure ergonomic grip in pry bar operations.

The pry bar, in another aspect, has an end cap which is gripping engaging the body of the handle. The metal end cap has radially outwardly extending serrated elements that are molded in matching serrated elements the thermoplastic body to secure the end cap in place when subjected to variously directed impact forces.

The pry bar handle, in another aspect, has a centerline and the metal end cap has a center line or axis, and the handle center line or axis is vertically displaced or affect from the metal end cap axis in the side elevational disposition, and the spatial displacement is commensurately proportional to the length of the handle.

DESCRIPTION OF THE PREFERRED EMBODIMENT

Figure 1:
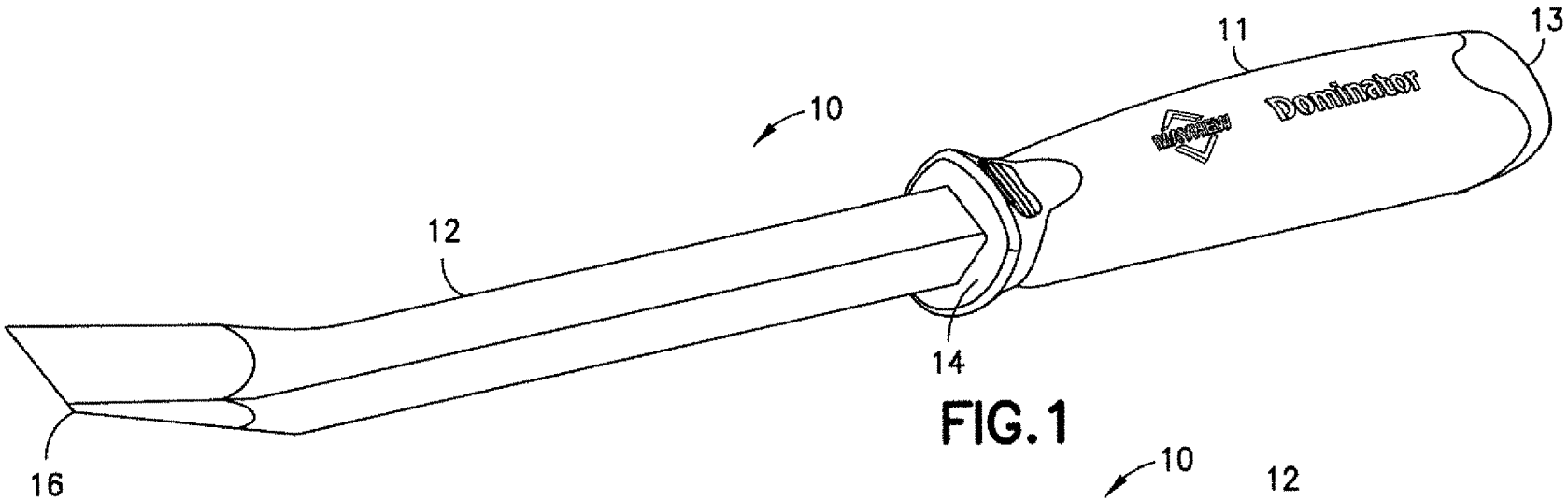
FIG. 1 is a top distal to proximate end perspective view of a first embodiment of the pry bar of the present invention.
Figure 2:
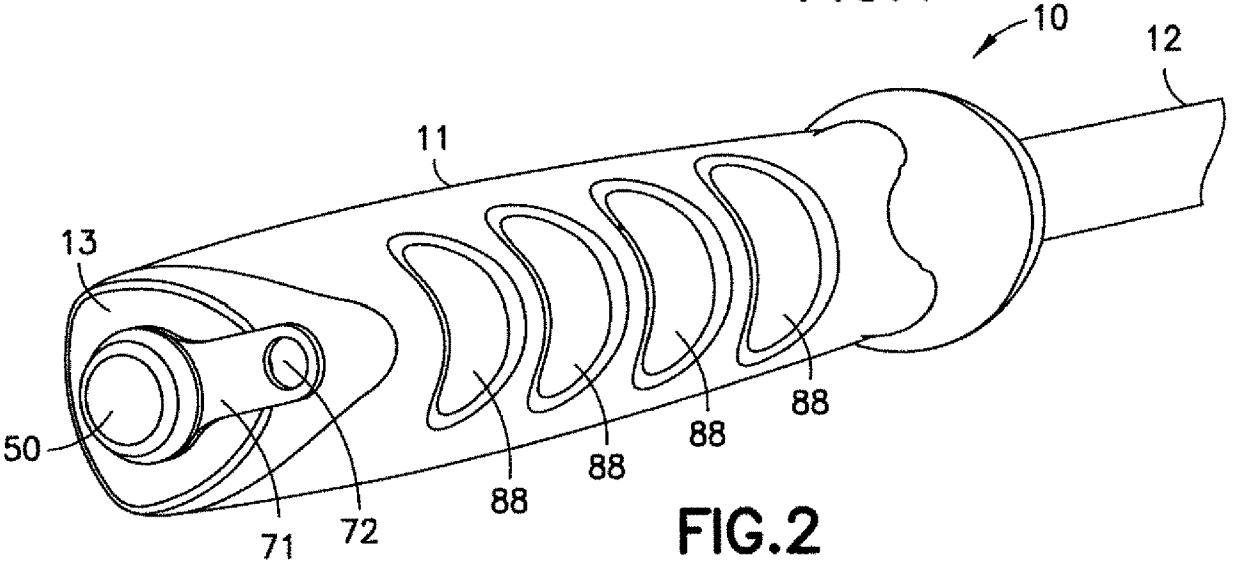
FIG. 2 is a bottom proximate to distal end prospective view of the pry bar of FIG. 1.
Figure 3:
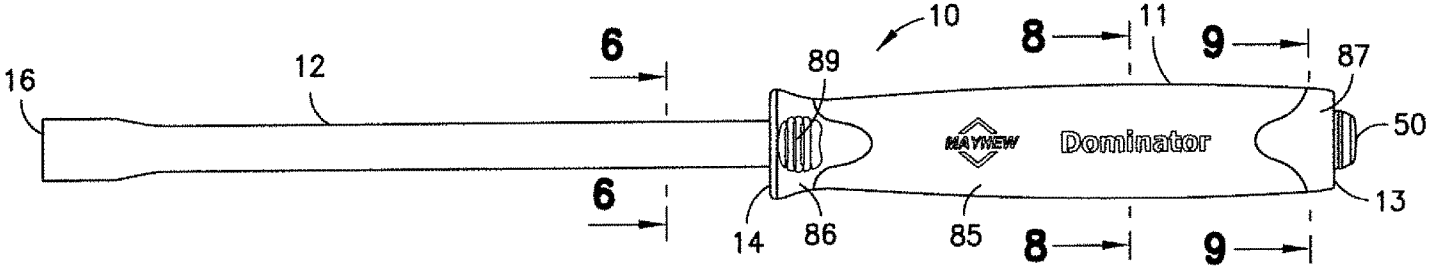
FIG. 3 is a top plan view of the pry bar of FIG. 1.
Figure 4:
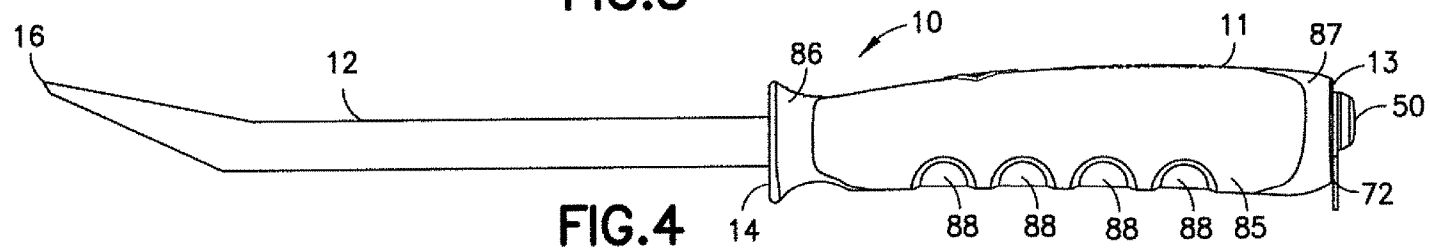
FIG. 4 is a side view of the pry bar as shown in FIG. 3.
Figure 6:
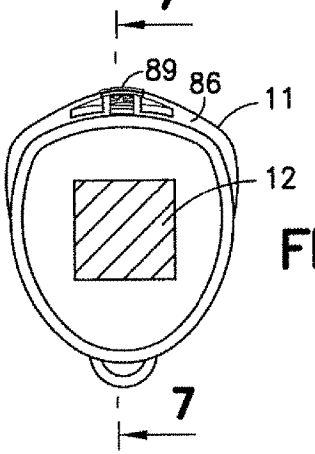
FIG. 6 is an enlarged sectional view taken along 6-6 of FIG. 3.
Figure 5:
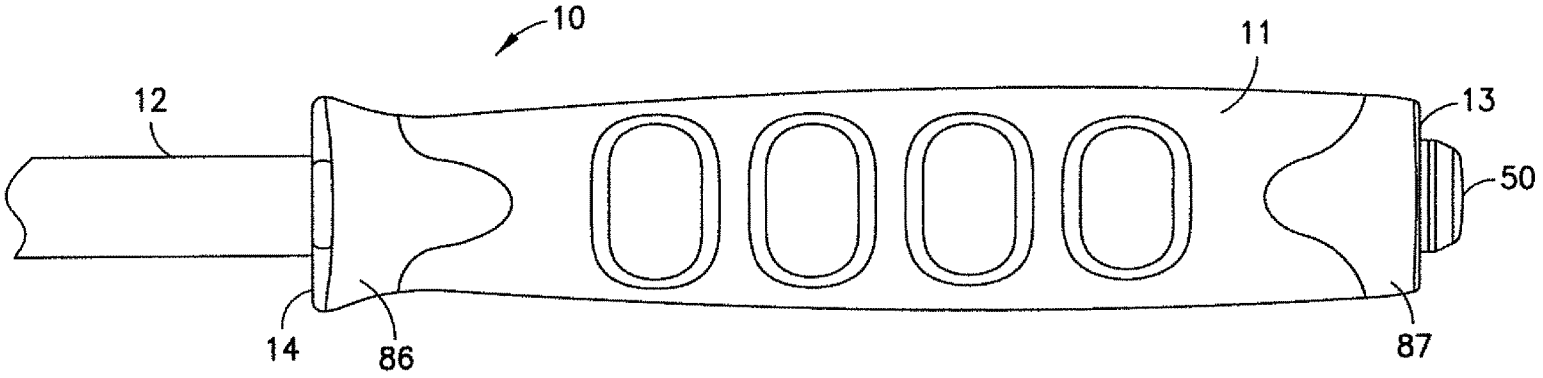
FIG. 5 is an enlarged bottom view of the pry bar as shown in FIG. 3.

Referring to FIGS. 1-9, there is shown a first embodiment pry bar 10 of the present invention. Pry bar 10, in general terms, includes handle 11 and a fixedly attached or secured metal blade or shank 12. Handle 11 has a planar proximate end 13 and a planar distal end 14. Blade 12 has a proximate end 15 (FIG. 7) and a distal end 16. Handle 11 is formed of a hard thermoplastic molded core 17 and a molded over integrally bonded elastomeric cover 18, wherein cover 18 is formed of relatively soft elastomeric material. The proximate end 15 of blade 12 is securely fixedly molded in core 17 rectilinear hole 91 with the formation of core 17. The elastomeric cover 18 is then molded over or around specific portions of the core 17, to provide a grip portion 95, as further discussed hereinafter. Blade 12 is of generally square cross-sectional bar stock construction and has a proximate end 15 and a distal end 16. Proximate end 15 is molded in situ with core 17, so as to be fixedly secured within handle 11, by means well known in the art.

A metal impact cap 50 is fixedly disposed or molded into the distal end of the handle 11. Cap 50 is secured within the handle core 17 by means well known in the thermoplastic molding art. Cap 50 is used, by way of example, to impact screw heads prior to driving same. The proximate end of core 17 is cooperatively formed with a serrated hole 92 for fixedly securing serrated portion 93 of metal cap 50 in the handle proximate end.

Blade distal end 16 is formed with a pry end 53. Pry end 53 has outwardly tapered sides 54, and upper and lower surfaces 56 and 57. Surfaces 56 and 57 are tapered and extend towards sharpened edge or tip 58. Tip 58 is upwardly angularly disposed with respect to shank 12.

Figure 7:
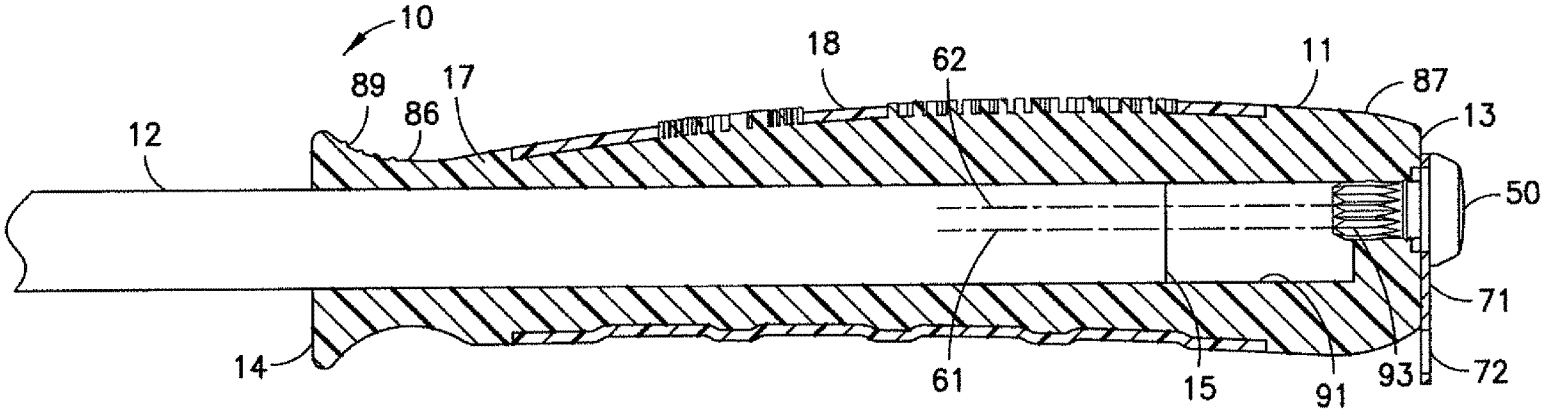
FIG. 7 is a sectional view taken along 7-7 of FIG. 6.
Figure 8:
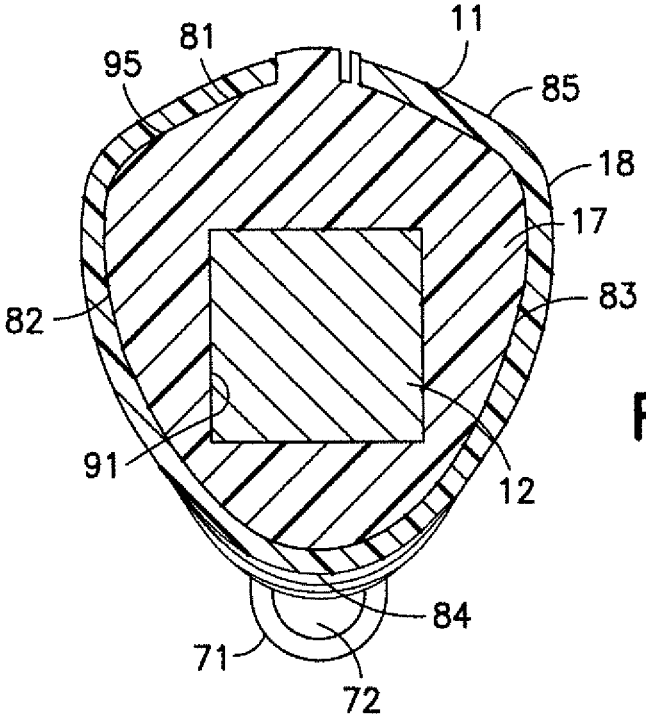
FIG. 8 is an enlarged sectional view taken along 8-8 of FIG. 3.
Figure 9:
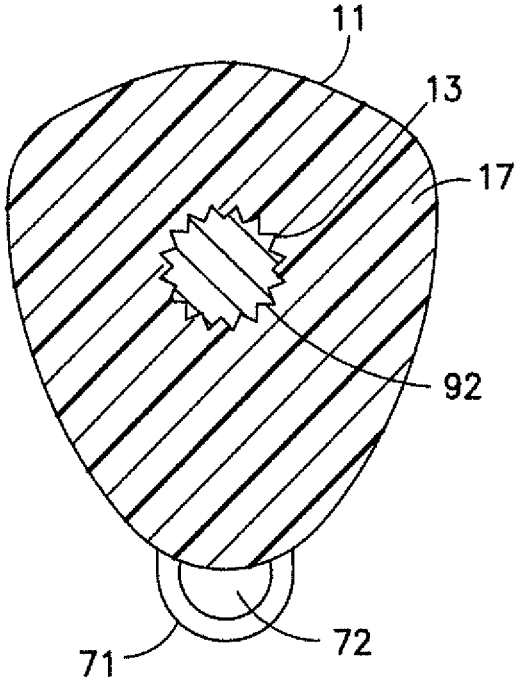
FIG. 9 is an enlarged sectional view taken along 9-9 of FIG. 3.
Figure 10:
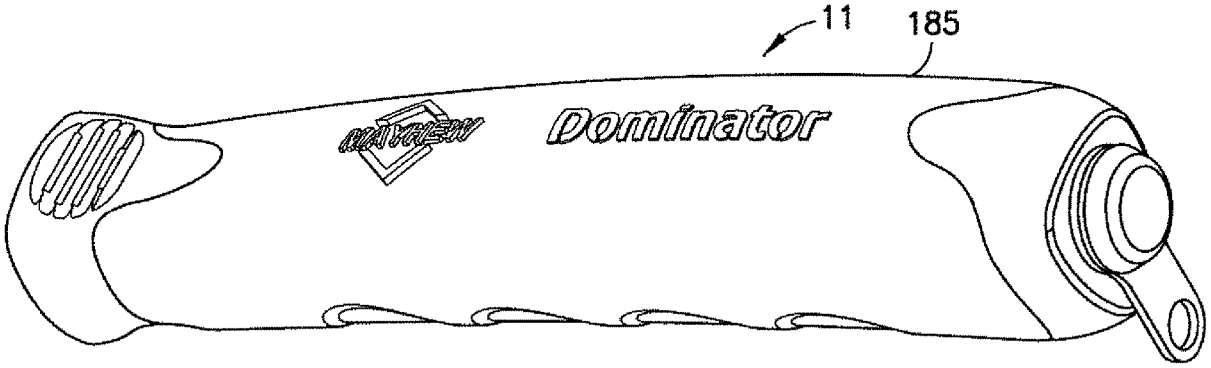
FIG. 10 is a perspective view of a second embodiment of the pry bar handle of the present invention.
Figure 11:
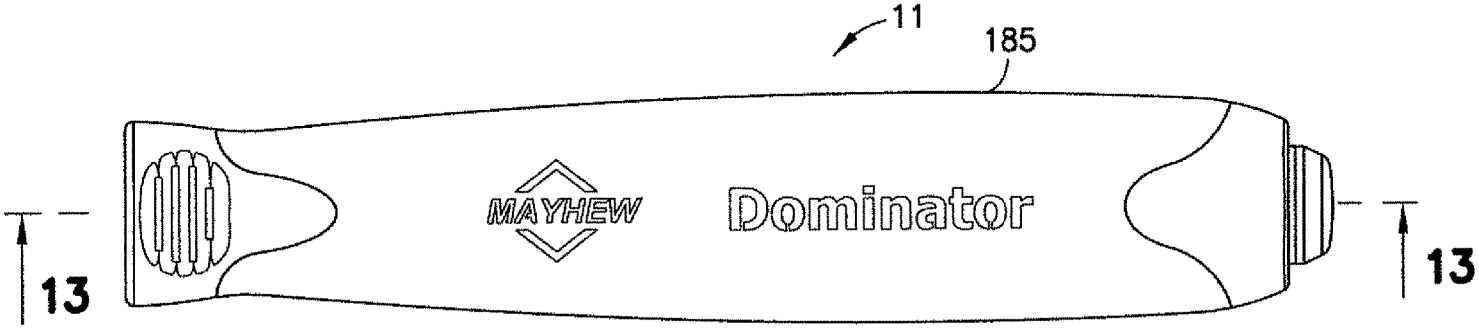
FIG. 11 is a top plan view of the pry bar handle of FIG. 10.
Figure 12:
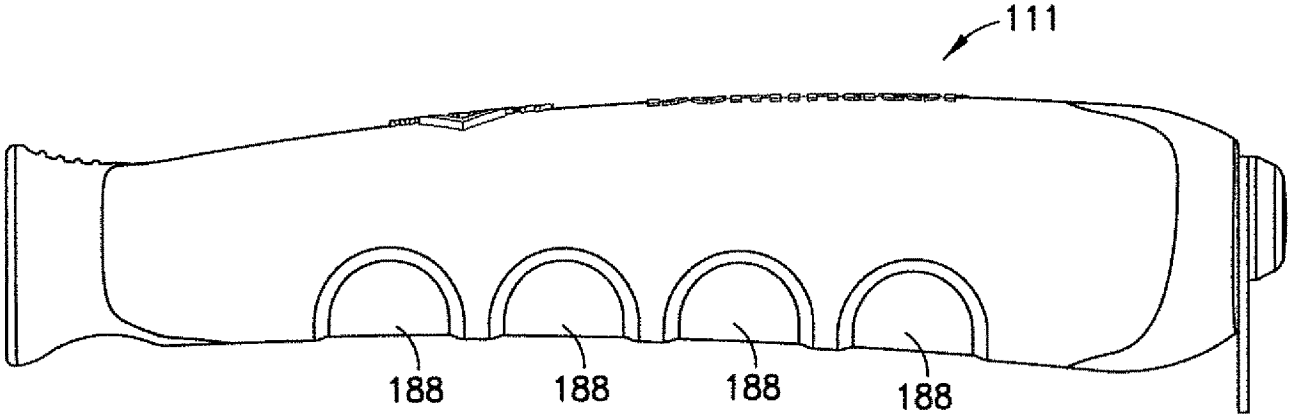
FIG. 12 is a side view of the pry bar of FIG. 11.
Figure 13:
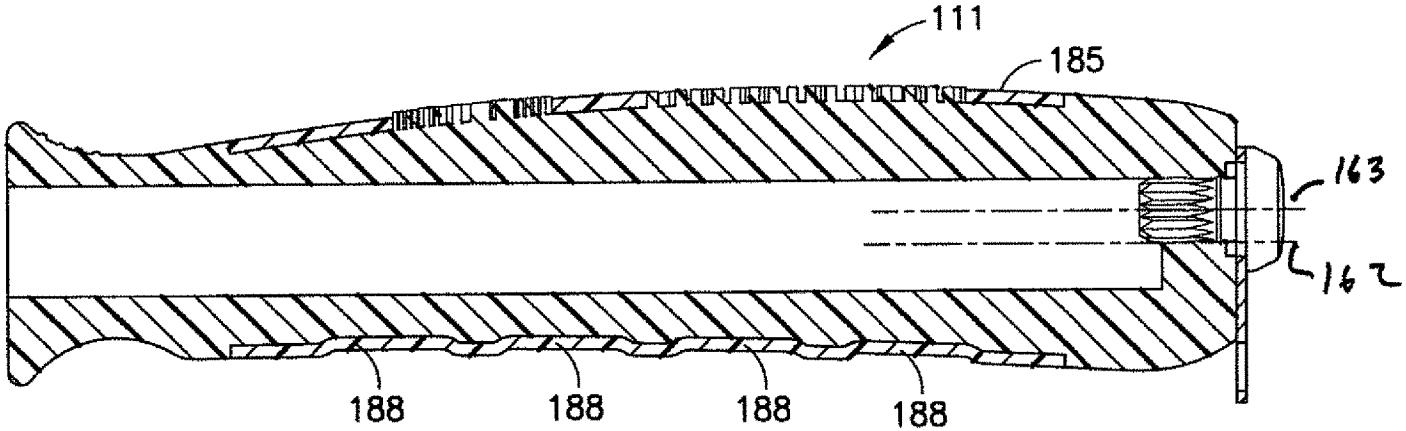
FIG. 13 is a sectional view taken along 13-13 of FIG. 11.
Figure 14:
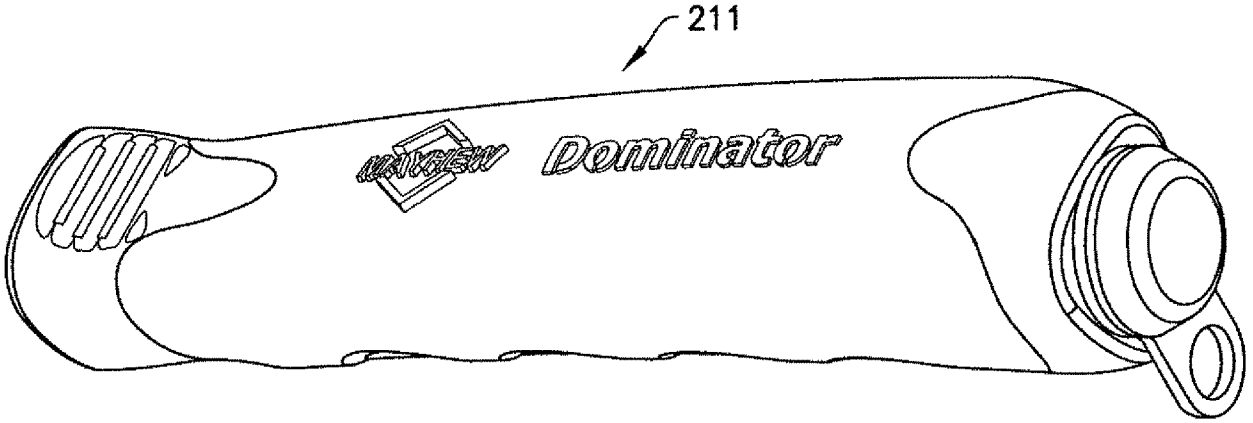
FIG. 14 is a perspective view of a third embodiment of the pry bar handle of the present invention.
Figure 15:
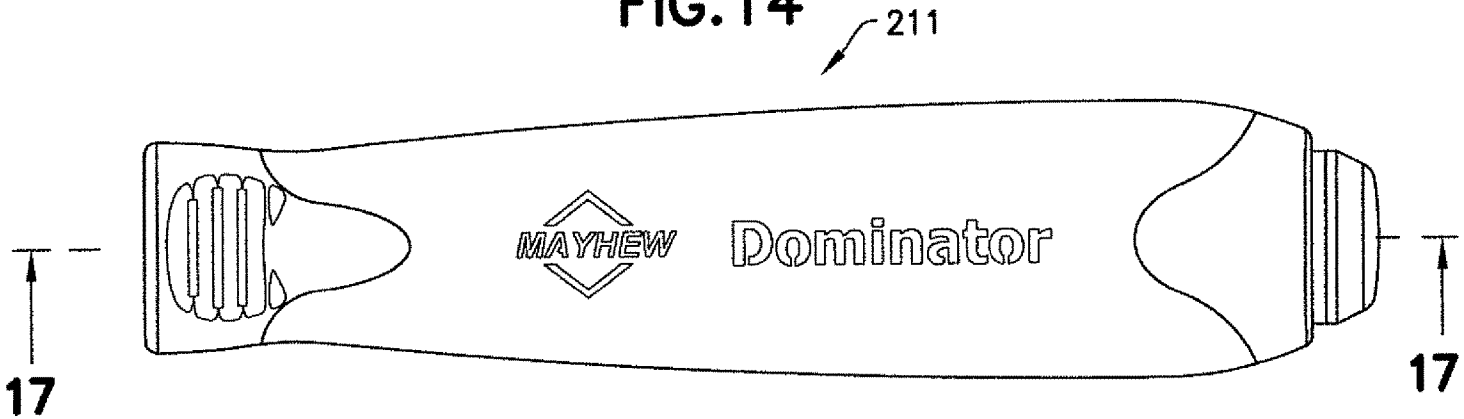
FIG. 15 is a top plan view of the pry bar handle of FIG. 14.
Figure 16:
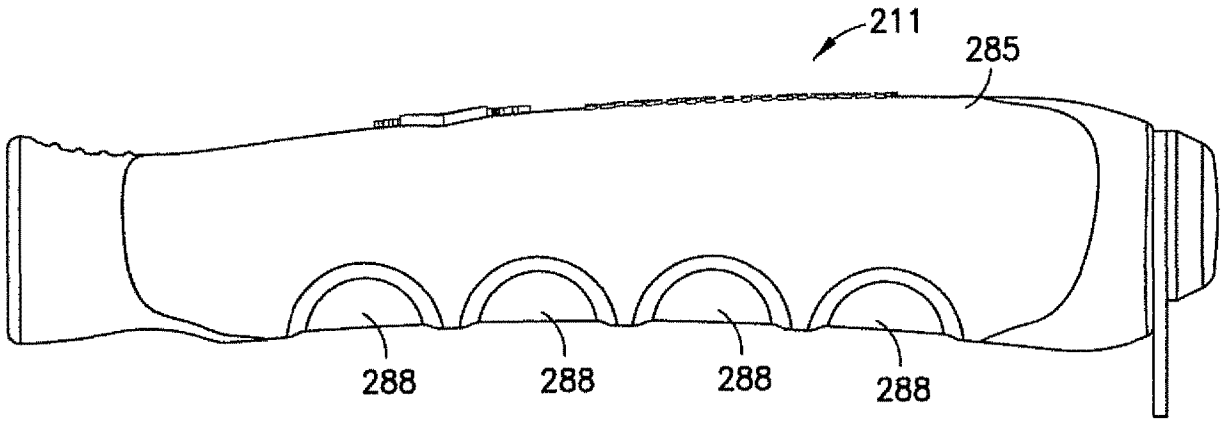
FIG. 16 is a side view of the pry bar handle of FIG. 15.
Figure 17:
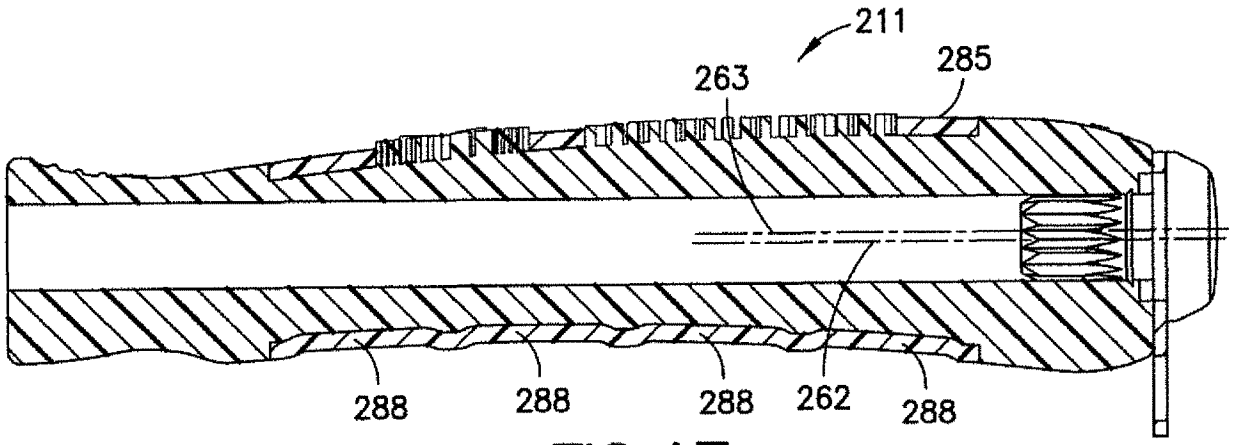
FIG. 17 is a sectional view taken along 17-17 of FIG. 15.
Figure 18:
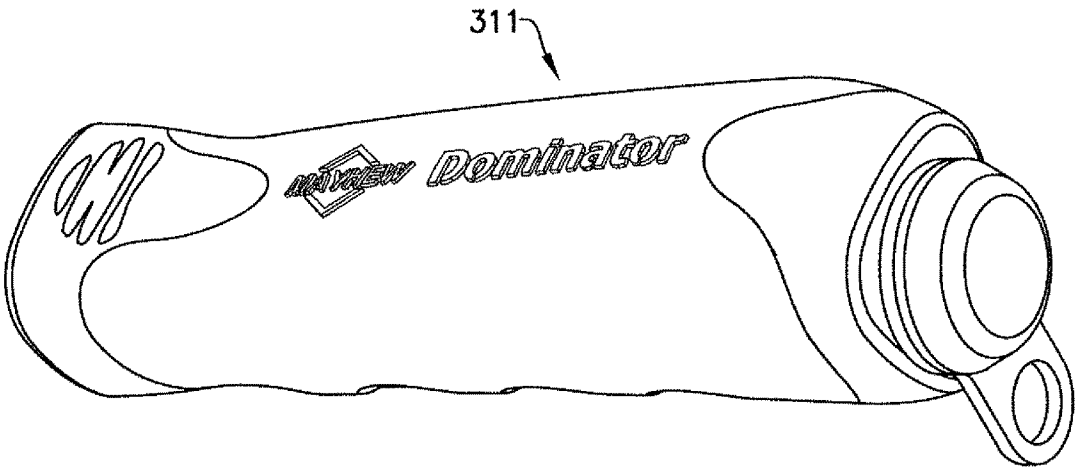
FIG. 18 is a perspective view of a fourth embodiment of the pry bar handle of the present invention.
Figure 19:
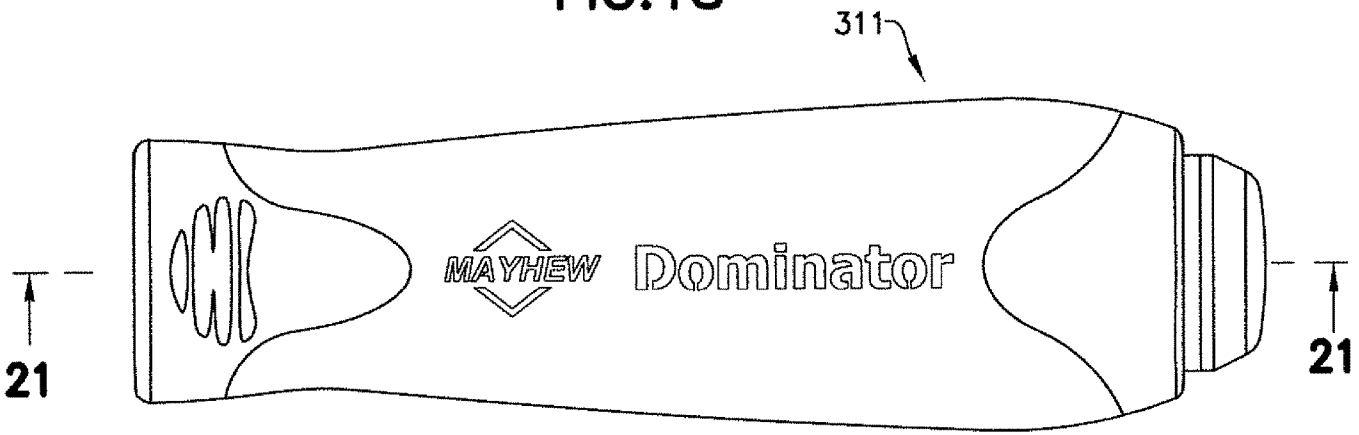
FIG. 19 is a top plan view of the pry bar handle of FIG. 18.
Figure 20:
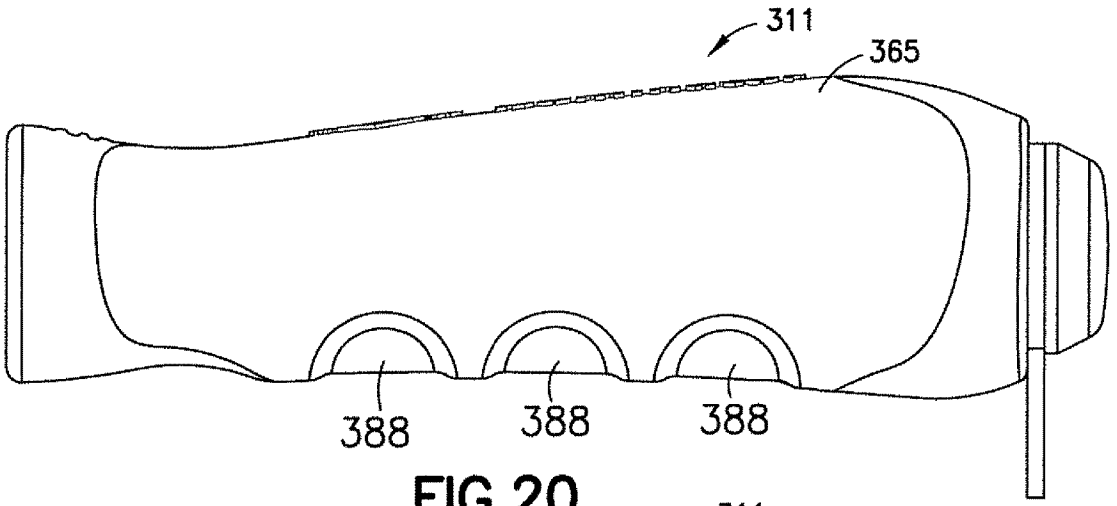
FIG. 20 is a side view of the pry bar handle of FIG. 19.

The elastomeric material cover 18 does not cover the entire core 17. Elastomeric material cover 18 is molded over hard thermoplastic core 17 peripherally in the triangular sectional shaped handle grip portion 95. Generally triangularly shaped cross-section grip portion 95 is formed of the upper or top upwardly cured first surface 81, and outwardly curved side surfaces 82 and 33, with bottom curved portion or apex 84 (FIG. 8). The grip portion 95 is over-molded as at 85 by elastomeric material so as to essentially surround the thermoplastic core at the grip portion. The respective distal 85 and proximate 87 thermoplastic core portions are exposed and not over-molded (FIGS. 3-7).

A series of four transversely disposed oval recesses 88 (typical) are formed at the bottom curved portion 84 and extend upwardly along the sides of over-molded elastomeric grip portion 85. The oval elastomeric recesses 88 extending upwardly from apex 84 and provide improved finger gripping functionality. Three to four elastomeric grip oval finger receiving recesses are provided commensurate with the length of the handle.

A series of parallel ridged elements 89 is formed in the upper exposed hand thermoplastic core to provide a thumb receiving and holding recess, in combination with the finger receiving oval recesses 88, for improved ergonomic grip.

A metal tang 71 with tether hole 72 is fixedly disposed between metal impact cap 50 and handle planar proximate end 13.

Handle 11 is formed with centerline 61, and metal impact cap is formed with axis or centerline 62. As best shown in FIG. 7, the centerlines 61 and 62 are spatially disposed or offset in the side elevational direction. The spatial disposition provides improved impact cap functionally in using the impact cap for heavy-duty diverse impact for use, and as further discussed hereinafter with respect to the embodiments of FIGS. 10-21.

Referring to FIGS. 10-13, there is shown a second embodiment handle III. Handle 111 is more elongated than handle 11. The handle centerline 162 is offset or spatially disposed from end cap centerline in axis 163 to a greater extent (FIG. 13) than lines 62 and 63. Handle III has the triangularly shaped sectional elastomeric grip portion 185 similar to that of first embodiment grip portion 85, with four oval finger recesses 188 (typical).

Referring to FIGS. 14-17, there is shown a third embodiment handle 211. Handle 211 is somewhat less elongated than handle 111. The handle centerline 252 is offset or spatially disposed from end cap centerline or axis 263 to a lesser degree (FIG. 17) than centerlines 162 and 163 of the second embodiment. Handle 211 is formed with elastomeric triangular grip portion 285 with four oval finger recesses 288 (typical), similar to that of embodiment 111.

Figure 21:
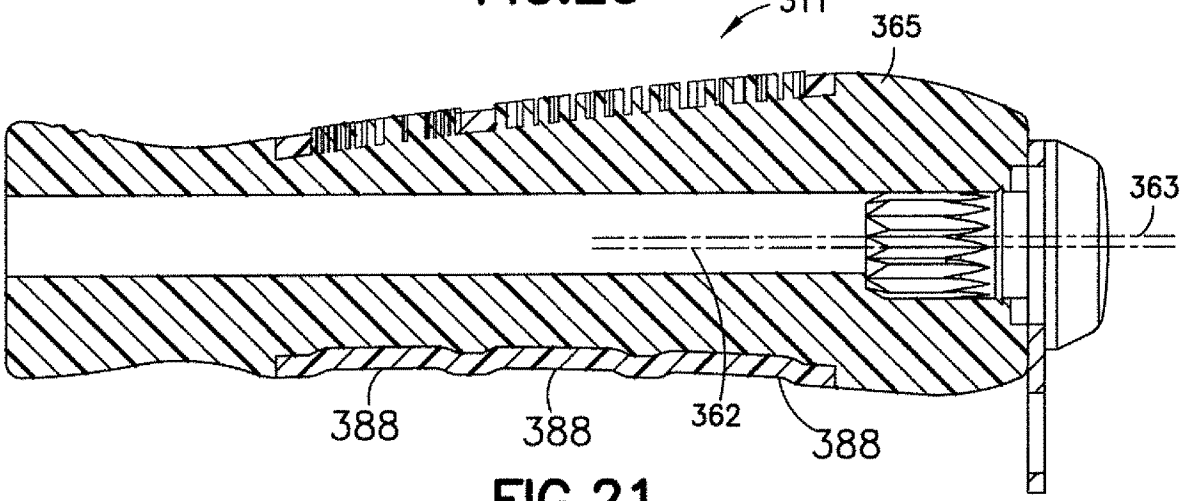
FIG. 21 is a sectional view of the pry bar handle taken along 21-21 of FIG. 19.

Referring to FIGS. 18-21, there is shown a fourth embodiment handle 311. Handle 311 is substantially less elongated than the prior embodiments. The handle 311 centerline 362 and end cap centerline or axis 363 are slightly offset and nearly coincident (FIG. 21). Handle 311 elevational triangular grip portion 365 is similar to that of the prior embodiment. However, handle 311 has only three oval finger recesses 388, and yet in this shorter compact embodiment provides an improved ergonomic grip.

As demonstrated in the FIGS., the vertical spatial disposition between the handle centerline and the end cap centerline or axis is commensurately proportioned to the length of the handle. This end cap and grip portion disposition, and in further combination with the generally triangular grip portion, provides improved grip functionally in both the pry bar and end cap operational modes.

The upper curved surfaces of handles 11, 111, 211 and 311 are shown with intermittent exposures of the thermoplastic core to provide in situ permanently legible trademarks and logos "MAYHEW" and "DOMINATOR". This construction prevents the wearing away or distortion of imprinted prior art markings or trademarks as is common in prior art constructions.

In the aforesaid manner of construction, the user grips the outwardly disposed thermoplastic portion and the upper elastomeric triangles contoured portion and places the thumb on one of the distally disposed ridged surfaces for an ergonomic grip.

The core may be molded of hard thermoplastic using and the cover may be molded of with elastomeric material by well-known molding methods.

The afore-described handle surfaces and contours, and in conjunction with the pry bar configuration and disposition with respect to the handle, provide an ergonomic pry bar.

While the foregoing describes certain embodiments of the invention, various modifications and changes may be made within the spirit and scope of the invention, as defined by the adjoined claims.

What is claimed is:

1. A pry bar comprising:

a handle having a distal end, a proximate end and a grip portion disposed between the ends;

said grip portion comprises an upper surface comprising an upwardly curved surface, a lower surface comprising a downwardly curved surface, and outwardly disposed curved side surfaces being more elongate than the upper and lower surfaces, and extending from the upper surface to the lower surface, wherein said grip portion curved surfaces comprise a transversely disposed generally triangular cross-section, said upper surface defining one side and the outwardly disposed curved side surfaces defining two sides of the generally triangular cross-section, said lower surface being lesser elongate than the other said surfaces and defining an apex of the generally triangular cross-section;

said handle further comprises an inner thermoplastic core and an outer integrally bonded elastomeric material;

further comprising an impact cap fixedly disposed in the thermoplastic core material at the proximate end of the handle;

said elastomeric material being disposed on the grip portion thermoplastic core surfaces;

a longitudinally extending rectilinear bore through said thermoplastic core;

a rectilinear pry bar blade, said blade having a proximate end and a distal end;

said blade proximate end being disposed fixedly within said handle bore; and said blade distal end being in angular upwardly extending disposition;

said rectilinear bore having a centerline, and said impact cap having a centerline, and wherein the centerlines are in spatial disposition in a side elevational view.

2. The pry bar of claim 1, said lower surface grip portion elastomeric material comprises respective peripheries of a plurality of longitudinally spaced generally oval grip elements.

3. The pry bar of claim 2, each said oval grip element extends upwardly at the respective sides.

4. The pry bar of claim 3, said grip portion elastomeric material being transversely disposed.

5. The pry bar of claim 1, further comprising a tang having a throughhole, said tang being disposed between the end of the fixedly disposed impact cap and the handle proximate end, said tang extends radially horizontally outwardly from the handle surface, so that the throughhole is disposed away from the handle.

6. The pry bar of claim 1, said curved lower surface being contiguous with each curved side surface, and each curved side surface being contiguous with the curved upper surface.

7. A handle having a distal end, a proximate end and a grip portion disposed between the ends;

said grip portion comprises an upper surface comprising an upwardly curved surface, a lower surface comprising a downwardly curved surface, and outwardly disposed curved side surfaces being more elongate than the upper and lower surfaces, and extending from the upper surface to the lower surface, wherein said grip portion curved surfaces comprise a transversely disposed generally triangular cross-section, said upper surface defining one side and the outwardly disposed curved side surfaces defining two sides of the generally triangular cross-section, said lower surface being lesser elongate than the other said surfaces and defining an apex of the generally triangular cross-section;

said handle further comprises an inner thermoplastic core and an outer integrally bonded elastomeric material;

said elastomeric material being disposed on the grip portion thermoplastic core surfaces;

further comprising an impact cap fixedly disposed in the thermoplastic core material at the proximate end of the handle;

a longitudinally extending bore through said thermoplastic core;

a pry bar blade, said blade having a proximate end and a distal end;

said blade proximate end being disposed within said handle bore; and said blade distal end being in angular upwardly extending disposition;

further comprising an impact cap fixedly disposed in the thermoplastic core material at the proximate end of the handle;

said impact cap comprises a center line, and said handle comprises a center line, and wherein the center lines are spacedly disposed in a side elevation disposition.

8. The pry bar of claim 7, wherein the impact cap center line is more adjacent the upper surface than the lower surface.

9. The pry bar of claim 7, wherein the impact cap comprises metal, and further comprises a plurality of radially extending metal serrations in parallel disposition with the impact cap centerline and grippingly engaged in the thermoplastic core.

10. The pry bar of claim 9, wherein the radially extending serrations are in parallel disposition with the handle and impact cap centerlines.

11. A plurality of pry bars of different handle lengths, each said pry bar comprises:

a handle having a distal end, a proximate end and a grip portion disposed between the ends;

said grip portion comprises an upper surface comprising an upwardly curved surface, a lower surface comprising a downwardly curved surface, and outwardly disposed curved side surfaces being more elongate than the upper and lower surfaces, and extending from the upper surface to the lower surface, wherein said grip portion curved surfaces comprise a transversely disposed generally triangular cross-section, said upper surface defining one side and the outwardly disposed curved side surfaces defining two sides of the generally triangular cross-section, and said lower surface being lesser elongate than the other said surfaces and defining an apex of the generally triangular cross-section;

said handle further comprises an inner thermoplastic core and an outer integrally bonded elastomeric material;

said elastomeric material being disposed on the grip portion thermoplastic core surfaces;

a longitudinally extending bore through said thermoplastic core;

a pry bar blade, said blade having a proximate end and a distal end;

said blade proximate end being disposed within said handle bore;

said blade distal end being in angular upwardly extending disposition, each said pry bar comprises an end cap fixedly disposed in the proximate end of the handle, and wherein the handle comprises a centerline and the cap comprises a centerline, and the centerlines are in spatial disposition; and wherein the spatial disposition is commensurately proportional to the length of the respective handle.

12. The plurality of pry bars of claim 11, said curved lower surface being contiguous with each curved side surface, and each curved side surface being contiguous with the curved upper surface.

* * * * *